US007131294B2

(12) United States Patent
Manole

(10) Patent No.: US 7,131,294 B2
(45) Date of Patent: Nov. 7, 2006

(54) METHOD AND APPARATUS FOR CONTROL OF CARBON DIOXIDE GAS COOLER PRESSURE BY USE OF A CAPILLARY TUBE

(75) Inventor: Dan M Manole, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 16 days.

(21) Appl. No.: 10/755,947

(22) Filed: Jan. 13, 2004

(65) Prior Publication Data

US 2005/0150248 A1 Jul. 14, 2005

(51) Int. Cl.
*F25B 41/00* (2006.01)
*G05D 27/00* (2006.01)
*F25B 1/00* (2006.01)

(52) U.S. Cl. ..... 62/513; 236/92 B; 236/92 R

(58) Field of Classification Search ..... 62/513, 62/115, 228.1, 229, 228.3, 228.5, 222, 498; 236/92 B, 92 R
See application file for complete search history.

(56) References Cited

U.S. PATENT DOCUMENTS

| | | | | |
|---|---|---|---|---|
| 3,274,797 | A | 9/1966 | Kritzer | 62/511 |
| 4,304,099 | A | 12/1981 | Vakil | 62/86 |
| 5,174,123 | A | 12/1992 | Erickson | 62/113 |
| 5,214,925 | A | 6/1993 | Hoy et al. | 62/50.6 |
| 5,245,836 | A | 9/1993 | Lorentzen et al. | 62/174 |
| 5,497,631 | A | 3/1996 | Lorentzen et al. | 62/115 |
| 5,685,160 | A | 11/1997 | Abersfelder et al. | 62/114 |
| 6,092,379 | A | 7/2000 | Nishida et al. | 62/200 |
| 6,189,326 | B1 | 2/2001 | Tomatsu et al. | 62/222 |
| 6,343,486 | B1 | 2/2002 | Mizukami | 62/509 |
| 6,351,950 | B1 * | 3/2002 | Duncan | 62/3.2 |
| 6,385,980 | B1 | 5/2002 | Sienel | 62/174 |
| 6,418,735 | B1 | 7/2002 | Sienel | 62/115 |
| 6,427,479 | B1 | 8/2002 | Komatsubara et al. | 62/503 |
| 6,457,325 | B1 | 10/2002 | Vetter | 62/473 |
| 6,584,796 | B1 | 7/2003 | Itah et al. | 62/324.1 |
| 6,901,763 | B1 * | 6/2005 | Memory et al. | 62/113 |

(Continued)

FOREIGN PATENT DOCUMENTS

EP 1 083 395 3/2001

(Continued)

OTHER PUBLICATIONS

Ritthong, W. et al.: "Size Selection of Capillary Tube for Refrigerant Mixtures", http://www.grad.cmu.ac.th/abstract/2000/eng/abstract/eng05009.html, (2000).

*Primary Examiner*—Chen Wen Jiang
(74) *Attorney, Agent, or Firm*—Baker & Daniels

(57) ABSTRACT

A transcritical vapor compression system that includes a fluid circuit circulating a refrigerant in a closed loop. The fluid circuit has operably disposed therein, in serial order, a compressor, a first heat exchanger, a first capillary tube and a second heat exchanger. The compressor compresses the refrigerant from a low pressure to a supercritical pressure. The first heat exchanger is positioned in a high pressure side of the fluid circuit and the second heat exchanger is positioned in a low pressure side of the fluid circuit. The first capillary tube reduces the pressure of the refrigerant from a supercritical pressure to a relatively lower pressure. The refrigerant flows through the first capillary tube at its critical velocity and means for controlling the temperature of the refrigerant in the first capillary tube are provided.

27 Claims, 2 Drawing Sheets

U.S. PATENT DOCUMENTS

2002/0046570 A1 4/2002 Itoh et al. ..... 62/324.1

FOREIGN PATENT DOCUMENTS

| | | |
|---|---|---|
| FR | 2 528 157 | 12/1983 |
| JP | 61-107068 | 5/1986 |
| JP | 11-63692 | 3/1999 |
| JP | 2001-108310 | 4/2001 |
| JP | 2001-133057 | 5/2001 |
| JP | 2002-221377 | 8/2002 |
| JP | 2002-349979 | 12/2002 |
| WO | WO 9007683 A1 * | 7/1990 |

* cited by examiner

METHOD AND APPARATUS FOR CONTROL OF CARBON DIOXIDE GAS COOLER PRESSURE BY USE OF A CAPILLARY TUBE

BACKGROUND OF THE INVENTION

1. Field of the Invention

The present invention relates to vapor compression systems and, more particularly, to a transcritical vapor compression system in which the efficiency and capacity of the system can be adjusted.

2. Description of the Related Art

Vapor compression systems are used in a variety of applications including heat pump, air conditioning, and refrigeration systems. Such systems typically employ working fluids, or refrigerants, that remain below their critical pressure throughout the entire vapor compression cycle. Some vapor compression systems, however, such as those employing carbon dioxide as the refrigerant, typically operate as transcritical systems wherein the refrigerant is compressed to a pressure exceeding its critical pressure and wherein the suction pressure of the refrigerant is less than the critical pressure of the refrigerant, i.e., is a subcritical pressure. The basic structure of such a system includes a compressor for compressing the refrigerant to a pressure that exceeds its critical pressure. Heat is then removed from the refrigerant in a first heat exchanger, e.g., a gas cooler. The pressure of the refrigerant exiting the gas cooler is reduced in an expansion device and the refrigerant then absorbs thermal energy in a second heat exchanger, e.g., an evaporator, before being returned to the compressor. The first heat exchanger of such a system can be used for heating purposes, alternatively, the second heat exchanger can be used for cooling purposes.

FIG. 1 illustrates a typical transcritical vapor compression system 10. In the illustrated example, a two stage compressor is employed having a first compression mechanism 12 and a second compression mechanism 14. The first compression mechanism compresses the refrigerant from a suction pressure to an intermediate pressure. An intercooler 16 is positioned between the first and second compression mechanisms and cools the intermediate pressure refrigerant. The second compression mechanism then compresses the refrigerant from the intermediate pressure to a discharge pressure that exceeds the critical pressure of the refrigerant. The refrigerant is then cooled in a gas cooler 18. In the illustrated example, a suction line heat exchanger 20 further cools the high pressure refrigerant before the pressure of the refrigerant is reduced by expansion device 22. The refrigerant then enters evaporator 24 where it is boiled and cools a secondary medium, such as air, that may be used, for example, to cool a refrigerated cabinet. The refrigerant discharged from the evaporator 24 passes through the suction line heat exchanger 20 where it absorbs thermal energy from the high pressure refrigerant before entering the first compression mechanism 12 to repeat the cycle.

The capacity and efficiency of such a transcritical system can be regulated by regulating the pressure of the refrigerant in gas cooler 18. The pressure of the high side gas cooler may, in turn, be regulated by regulating the mass of refrigerant contained therein which is dependent upon, among other things, the total charge of refrigerant actively circulating through the system. It is known to provide a reservoir in communication with the system for retaining a variable mass of refrigerant. The total charge of refrigerant actively circulating through the system can then be adjusted by changing the mass of refrigerant contained within the reservoir. By regulating the mass of refrigerant actively circulated through the system, the pressure of the refrigerant in the gas cooler can also be regulated. One problem associated with use of such reservoirs to contain a variable mass of refrigerant is that they can increase the cost and complexity of the system.

An alternative apparatus and method for adjusting the efficiency and capacity of a transcritical vapor compression system is desirable.

SUMMARY OF THE INVENTION

The present invention provides a vapor compression system that includes an expansion device in the form of a capillary tube and means for controlling the temperature of the refrigerant within the capillary tube. The temperature of the refrigerant within the capillary tube can be adjusted to control the ratio of refrigerant liquid to refrigerant vapor in the capillary tube and, thus, the density of the refrigerant within the tube. Regulating the temperature, and consequently density, of the refrigerant also regulates the velocity and mass flow rate of refrigerant through the capillary tube which in turn regulates the capacity of the system.

The invention comprises, in one form thereof, a transcritical vapor compression system including a fluid circuit circulating a refrigerant in a closed loop. The fluid circuit has operably disposed therein, in serial order, a compressor, a first heat exchanger, a first capillary tube and a second heat exchanger. The compressor compresses the refrigerant from a low pressure to a supercritical pressure. The first heat exchanger is positioned in a high pressure side of the fluid circuit and the second heat exchanger is positioned in a low pressure side of the fluid circuit. The first capillary tube reduces the pressure of the refrigerant from a supercritical pressure to a relatively lower pressure and refrigerant passes through the first capillary tube at a velocity having a maximum value substantially equivalent to the critical velocity of the refrigerant. Means for controlling the temperature of the refrigerant in the first capillary tube is also provided.

The present invention comprises, in another form thereof, a transcritical vapor compression system including a fluid circuit circulating a refrigerant in a closed loop. The fluid circuit has operably disposed therein, in serial order, a compressor, a first heat exchanger, a first capillary tube and a second heat exchanger. The compressor compresses the refrigerant from a low pressure to a supercritical pressure. The first heat exchanger is positioned in a high pressure side of the fluid circuit and the second heat exchanger is positioned in a low pressure side of the fluid circuit. The first capillary tube reduces the pressure of the refrigerant from a supercritical pressure to a relatively lower pressure and refrigerant passes through the first capillary tube at a velocity having a maximum value substantially equivalent to the critical velocity of the refrigerant. A device disposed in thermal exchange with the fluid circuit proximate the first capillary tube is also provided whereby the temperature of the refrigerant in the first capillary tube is adjustable with the device.

The present invention comprises, in yet another form thereof, a transcritical vapor compression system including a fluid circuit circulating a refrigerant in a closed loop. The fluid circuit has operably disposed therein, in serial order, a compressor, a first heat exchanger, a first capillary tube and a second heat exchanger. The compressor compresses the refrigerant from a low pressure to a supercritical pressure. The first heat exchanger is positioned in a high pressure side of the fluid circuit and the second heat exchanger is positioned in a low pressure side of the fluid circuit. The first capillary tube reduces the pressure of the refrigerant from a supercritical pressure to a relatively lower pressure and the refrigerant passes through the first capillary tube at a velocity having a maximum velocity substantially equivalent to the critical velocity of the refrigerant. An internal heat exchanger exchanges thermal energy between the refrigerant at a first location in the fluid circuit between the first heat exchanger and the first capillary tube and the refrigerant at a second location in the low pressure side of the fluid circuit.

The present invention comprises, in a further form thereof, a method of controlling a transcritical vapor compression system, including providing a fluid circuit circulating a refrigerant in a closed loop. The fluid circuit has operably disposed therein, in serial order, a compressor, a first heat exchanger, a first capillary tube and a second heat exchanger. The refrigerant is compressed from a low pressure to a supercritical pressure in the compressor. Thermal energy is removed from the refrigerant in the first heat exchanger. The pressure of the refrigerant is reduced as it is passed through the first capillary tube. Thermal energy is added to the refrigerant in the second heat exchanger. The capacity of the system is regulated by controlling the mass flow rate of the refrigerant through the first capillary tube. Such a method may involve adjusting the temperature of the refrigerant while passing the refrigerant through the first capillary tube at a substantially constant velocity.

An advantage of the present invention is that the capacity and efficiency of the system can be regulated with inexpensive non-moving parts. Thus, the system of the present invention is less costly and more reliable than prior art systems.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
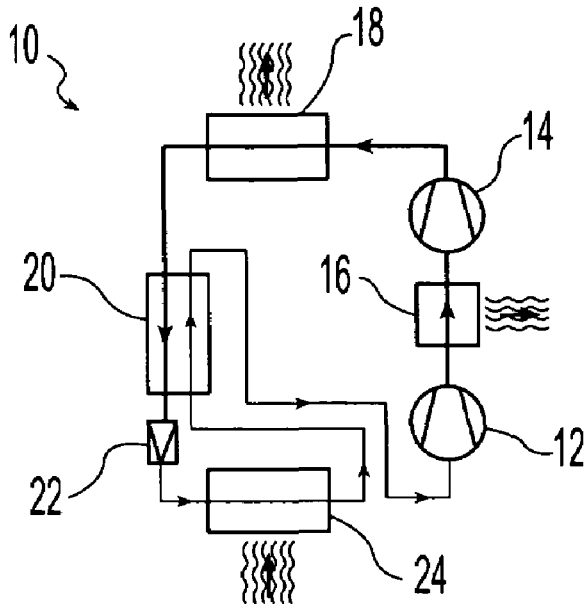
Fig. 1 (Prior Art)
FIG. 1 is a schematic representation of a prior art vapor compression system.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

Figure 2:
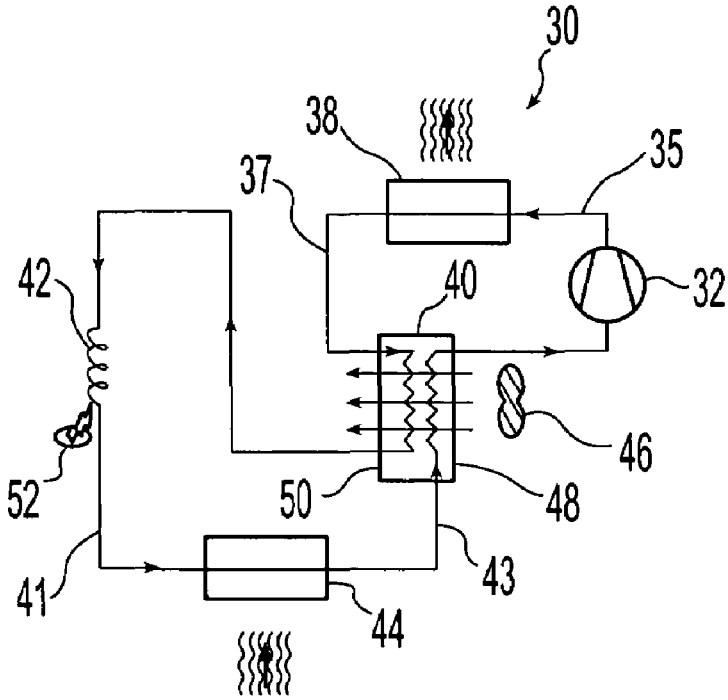
FIG. 2 is a schematic view of a vapor compression system in accordance with the present invention.

A vapor compression system 30 in accordance with the present invention is schematically illustrated in FIG. 2 as including a fluid circuit circulating refrigerant in a closed loop. System 30 has a compression mechanism 32 which may be any suitable type of compression mechanism such as a rotary, reciprocating or scroll-type compressor mechanism. The compression mechanism 32 compresses the refrigerant, e.g., carbon dioxide, from a low pressure to a supercritical pressure. A heat exchanger in the form of a conventional gas cooler 38 cools the refrigerant discharged from compression mechanism 32. Another heat exchanger in the form of suction line heat exchanger 40 further cools the high pressure refrigerant. The pressure of the refrigerant is reduced from a supercritical pressure to a lower subcritical pressure by an expansion device in the form of a capillary tube 42.

The capillary tube 42 can be a piece of drawn copper tubing, for example. The dimensions of the capillary tube 42 can be approximately the same as the typical dimensions of a conventional capillary tube. For example, the capillary tube 42 can have an inside diameter of approximately between 0.5 mm and 2.0 mm and a length approximately between 1 meter and 6 meters, however, capillary tubes having other dimensions may also be used with the present invention. The inside diameter as well as an equivalent roughness of the capillary tube 42 can be constant along the length of the tube 42. The refrigerant experiences a substantial pressure drop from the inlet to the outlet of the capillary tube 42. The magnitude of the pressure drop has an inverse relationship with the inside diameter of the tube 42. Other parameters, however, such as the pressure of the refrigerant at the inlet of tube 42 may also affect the magnitude of the pressure drop.

After the pressure of the refrigerant is reduced by capillary tube 42, the refrigerant enters another heat exchanger in the form of an evaporator 44 positioned in the low pressure side of the fluid circuit. The refrigerant absorbs thermal energy in the evaporator 44 as the refrigerant is converted from a liquid phase to a vapor phase. The evaporator 44 may be of a conventional construction well known in the art. After exiting evaporator 44, the low or suction pressure refrigerant passes through heat exchanger 40 to cool the high pressure refrigerant. More particularly, heat exchanger 40 exchanges thermal energy between the relatively warm refrigerant at a first location in the high pressure side of the fluid circuit and the relatively cool refrigerant at a second location in the low pressure side of the fluid circuit. After passing through the heat exchanger 40 on the low pressure side of the fluid circuit, the refrigerant is returned to compression mechanism 32 and the cycle is repeated.

Schematically represented fluid lines or conduits 35, 37, 41, and 43 provide fluid communication between compression mechanism 32, gas cooler 38, capillary tube 42, evaporator 44 and compression mechanism 32 in serial order. Heat exchanger 40 exchanges thermal energy between different points of the fluid circuit that are located in that portion of the circuit schematically represented by conduits 37 and 43 cooling the high pressure refrigerant conveyed within line 37. The fluid circuit extending from the outlet of the compression mechanism 32 to the inlet of the compression mechanism 32 has a high pressure side and a low pressure side. The high pressure side extends from the outlet of compression mechanism 32 to capillary tube 42 and includes conduit 35, gas cooler 38 and conduit 37. The low pressure side extends from capillary tube 42 to compression mechanism 32 and includes conduit 41, evaporator 44 and conduit 43.

According to the present invention, the system 30 includes a device for directly or indirectly controlling the temperature of the refrigerant in the capillary tube 42. Controlling the temperature of the refrigerant in capillary tube 42 provides for the regulation of the pressure of the refrigerant in the gas cooler 38, and, in turn, the capacity and/or efficiency of the system 30. For example, the system 30 may include an auxiliary cooling device in the form of an adjustable air mover such as a fan 46 for blowing air over the heat exchanger 40. By controlling the speed of fan 46 the rate of cooling of the refrigerant in the high pressure side of the fluid circuit can be controlled. The speed of fan 46 may be continuously adjustable or have a limited number of different speed settings. It would also be possible to use a single speed fan with a damper or other device for controlling the flow of air over heat exchanger 40. Moreover, the fan 46 may be disposed proximate or adjacent the capillary tube 42 such that the air flow from the fan 46 may cool the capillary tube 42 and the refrigerant therein more directly. The fan 46 is shown as being oriented to blow air from a low pressure portion 48 to a high pressure portion 50 of the heat exchanger 40, however, other configurations are also possible. The fan 46 and the heat exchanger 40 form a temperature adjustment device capable of adjusting the temperature of the refrigerant in the capillary tube 42 and, thus, adjusting the capacity of the system as described in greater detail below.

In addition to the fan 46, or in place of the fan 46, the system 30 may also include a heater/cooler 52 associated with the capillary tube 42. More particularly, the heating/cooling device 52 may be disposed proximate or adjacent the capillary tube 42 such that device 52 can heat or cool the capillary tube 42 and the refrigerant therein.

In operation, the illustrated embodiment of system 30 is a transcritical system utilizing carbon dioxide as the refrigerant wherein the refrigerant is compressed above its critical pressure and returns to a subcritical pressure with each cycle through the vapor compression system. Refrigerant enters the capillary tube 42 at a supercritical pressure and the pressure of the refrigerant is lowered to a subcritical pressure as the refrigerant progresses through the tube 42.

The velocity at which the refrigerant flows through the capillary tube 42 increases with increases in the pressure differential between the inlet and outlet of capillary tube 42 until the refrigerant reaches a critical velocity at which point, further increases in the pressure differential between the inlet and outlet of the capillary tube will not substantially increase the velocity of the refrigerant within the capillary tube. At this critical or choke velocity, the refrigerant inside the capillary tube 42 is moving at approximately the speed of sound. Changes in the temperature, and thus density, of the refrigerant when the refrigerant is flowing through capillary tube 42 at or near its critical velocity, will change the mass flow rate of the refrigerant through the tube. Although changes in the temperature and density of the refrigerant may alter the critical velocity of the refrigerant, the changes in the density of the refrigerant caused by a change in temperature will be of far greater significance than the change in the critical velocity of the refrigerant and, consequently, by controlling the temperature of the refrigerant through capillary tube 42 when the refrigerant is at or near its critical velocity the mass flow rate of the refrigerant through system 30 can be effectively controlled.

Capacity control for a transcritical system is typically accomplished by regulating the pressure in the gas cooler while maintaining the mass flow rate of the system substantially constant. However, controlling the mass flow rate while maintaining a substantially constant pressure in the gas cooler can also be used to control the capacity of a transcritical system.

As mentioned above, the mass flow rate through expansion device 42 can be controlled by regulating the vapor/liquid ratio of the refrigerant within the expansion device which is, in turn, a function of the temperature of the refrigerant within expansion device 42. For example, an increase in the temperature of the refrigerant within the expansion device, e.g., capillary tube 42, results in a decrease in the liquid/vapor ratio, i.e., a decrease in density, of the refrigerant exiting capillary tube 42. When the velocity of the refrigerant within capillary tube 42 is at the critical or choke velocity and, thus, the velocity of the refrigerant in capillary tube 42 is effectively invariable, a decrease in the density of the refrigerant results in a corresponding decrease in the mass flow rate of the refrigerant through the expansion device. On the other hand, a decrease in the temperature in the expansion device results in an increase in the liquid/vapor ratio, i.e., an increase in density, of the refrigerant exiting capillary tube 42 and an increase in the mass flow rate of the refrigerant through the expansion device. By regulating the temperature of the refrigerant in the capillary tube 42, the mass flow rate through system 30 can thereby be controlled and, consequently, the capacity of system 30 can also be controlled.

Figure 3:
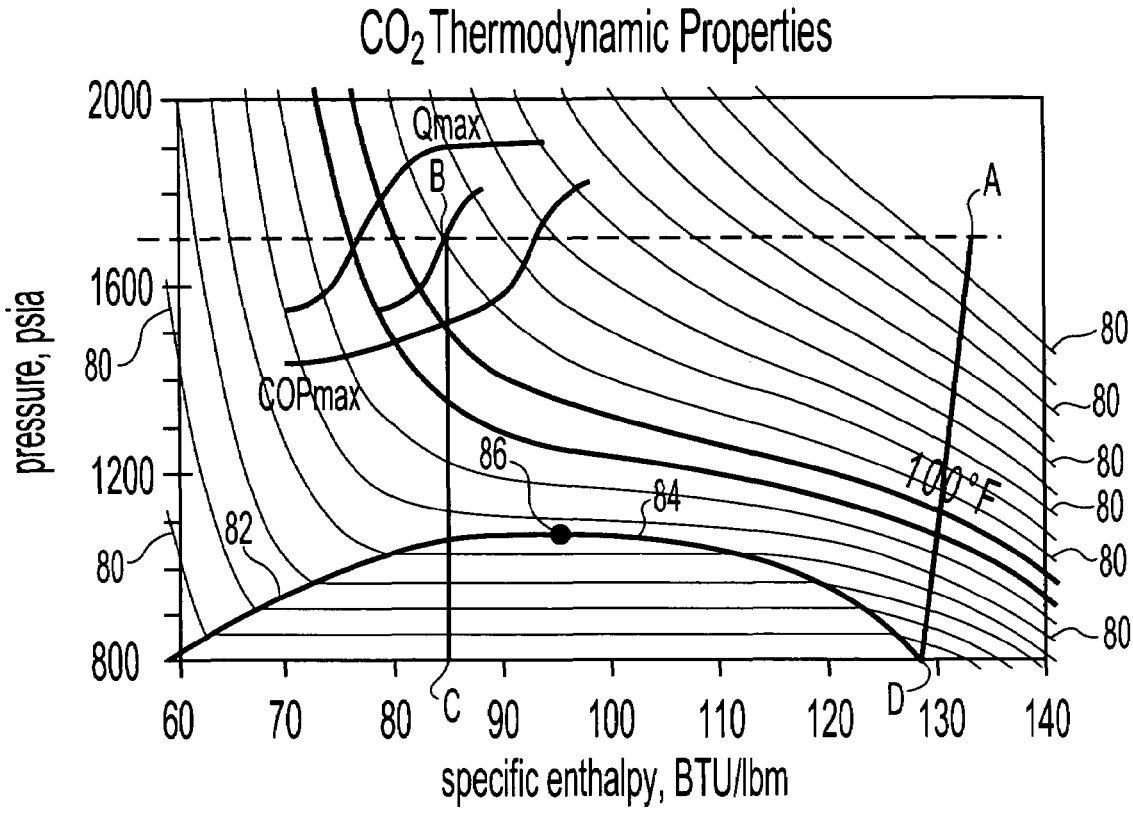
FIG. 3 is a graph illustrating the thermodynamic properties of carbon dioxide.

The thermodynamic properties of carbon dioxide are shown in the graph of FIG. 3. Lines 80 are isotherms and represent the properties of carbon dioxide at a constant temperature. Lines 82 and 84 represent the boundary between two phase conditions and single phase conditions and meet at point 86, a maximum pressure point of the common line defined by lines 82, 84. Line 82 represents the liquid saturation curve while line 84 represents the vapor saturation curve.

The area below lines 82, 84 represents the two phase subcritical region where boiling of carbon dioxide takes place at a constant pressure and temperature. The area above point 86 represents the supercritical region where cooling or heating of the carbon dioxide does not change the phase (liquid/vapor) of the carbon dioxide. The phase of a carbon dioxide in the supercritical region is commonly referred to as "gas" instead of liquid or vapor.

Point A represents the refrigerant properties as discharged from compression mechanism 32 (and at the inlet of gas cooler 38). Point B represents the refrigerant properties at the inlet to capillary tube 42 (if system 30 did not include heat exchanger 40, point B would also represent the outlet of gas cooler 38). Point C represents the refrigerant properties at the inlet of evaporator 44 (or outlet of capillary tube 42). Point D represents the refrigerant at the inlet to compression mechanism 32 (if system 30 did not include heat exchanger 40, point C would also represent the outlet of evaporator 44). Movement from point D to point A represents the compression of the refrigerant. As can be seen, compressing the refrigerant both raises its pressure and its temperature. Moving from point A to point B represents the cooling of the high pressure refrigerant at a constant pressure in gas cooler 38 (and heat exchanger 40). Movement from point B to point C represents the action of capillary tube 42 which lowers the pressure of the refrigerant to a subcritical pressure. Movement from point C to point D represents the action of evaporator 44 (and heat exchanger 40). Since the refrigerant is at a subcritical pressure in evaporator 44, thermal energy is transferred to the refrigerant to change it from a liquid phase to a vapor phase at a constant temperature and pressure. The capacity of the system (when used as a cooling system) is determined by the mass flow rate through the system and the location of point C and the length of line C-D which in turn is determined by the specific enthalpy of the refrigerant at the evaporator inlet.

The lines $Q_{max}$ and $COP_{max}$ represent gas cooler discharge values (i.e., the location of point B) for maximizing the capacity and efficiency respectively of the system. The central line positioned therebetween represents values that provide relatively high, although not maximum, capacity and efficiency. By operating the system along the central line between the $Q_{max}$ and $COP_{max}$ curves, when the system fails to operate precisely according to the design parameters defined by this central line, the system will suffer a decrease in either the capacity or efficiency and an increase in the other value unless such variances are of such magnitude that they represent a point no longer located between the $Q_{max}$ and $COP_{max}$ lines.

Thus, while altering the efficiency of the system requires altering the relative position of point B (representing the temperature and pressure of the refrigerant at the inlet to the expansion device) in FIG. 3, the capacity of the system can be altered by changing either the relative position of point B, and hence the length of line C–D, or by altering the mass flow rate of the system.

In system 30, the adjustment of the temperature of the refrigerant entering capillary tube 42 adjusts both the mass flow rate of the system and the relative of point B. By increasing the temperature, the density, and thus the mass flow rate, of the refrigerant decreases and point B moves to the right, both of which act to decrease the capacity of the system. By decreasing the temperature of the refrigerant, the density, and mass flow rate, increase and point B moves to the left, both of which act to increase the capacity of the system. Thus, it can be seen that the capacity of the system can be controlled by controlling the temperature of the refrigerant within capillary tube 42. The movement of point B (i.e., changes in the temperature and pressure of the refrigerant at the inlet to the expansion device as represented by point B in FIG. 3) will also affect the efficiency of the system, however, the adjustment of the system capacity and efficiency effected by the relative repositioning of point B may be relatively insignificant compared to the change in capacity effected by the change in the mass flow rate.

The system 30 has been shown herein as including an internal heat exchanger 40. However, it is to be understood that it is also possible within the scope of the present invention for the vapor compression system to not include an internal heat exchanger 40. Moreover, regardless of whether a heat exchanger 40 is present, it is possible for an air mover, such as fan 46 to blow air directly on capillary tube 42 or fluid line 37 at a position proximate capillary tube 42 in order to control the temperature of the refrigerant within capillary tube 42.

The system 30 has been described above as including one or both of the fan 46 and the heater/cooler 52 in order to change the temperature and density of the refrigerant within the capillary tube 42. The present invention is not limited to these exemplary embodiments of a heating or cooling device, however. Rather, the present invention may include any device 52 capable of heating or cooling the refrigerant. For example, device 52 may be a Peltier device. Peltier devices are well known in the art and, with the application of a DC current, move heat from one side of the device to the other side of the device and, thus, could be used for either heating or cooling purposes. Other devices that might be used include electrical resistance heaters and heat pipes. Fans or other air movers could also be used alone to form device 52 or in conjunction with other such devices. Further, the heating/cooling device can be disposed in association with either the capillary tube 42 or some other component of the fluid circuit upstream of capillary tube 42, such as the heat exchanger 40, where the heating/cooling device affects the refrigerant temperature more indirectly.

Figure 4:
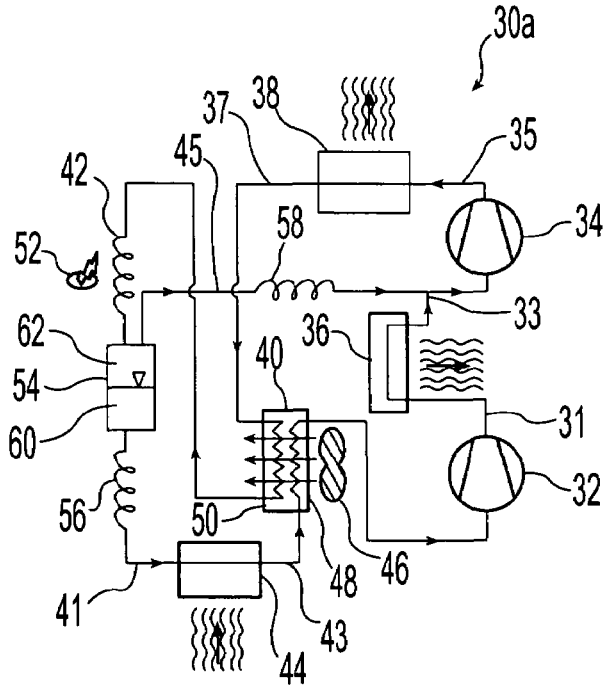
FIG. 4 is a schematic view of another vapor compression system in accordance with present invention.

A second embodiment 30*a* of a transcritical vapor compression system in accordance with the present invention is schematically represented in FIG. 4. System 30*a* is similar to system 30 shown in FIG. 2 but, in addition to the components of system 30, system 30*a* also includes a second compressor mechanism 34, an intermediate cooler 36, a mass storage tank or flash gas vessel 54, a second capillary tube 56 and a third capillary tube 58. System 30*a* also includes additional fluid lines or conduits 31, 33, and 45. Flash gas vessel 54 stores both liquid phase refrigerant 60 and vapor phase refrigerant 62.

In this embodiment, the first compressor mechanism 32 compresses the refrigerant from a low pressure to an intermediate pressure. Intercooler 36 is positioned between compressor mechanisms 32, 34 to cool the intermediate refrigerant. After the fluid line 33 communicates the refrigerant to the second compressor mechanism 34, the second compressor mechanism 34 compresses the refrigerant from the intermediate pressure to a supercritical pressure. The refrigerant entering second compressor mechanism 34 also includes refrigerant communicated from flash gas vessel 54 through fluid line 45 to fluid line 33. More particularly, a capillary tube 58 is disposed in the fluid line 45 and reduces the pressure of the refrigerant from flash gas vessel 54 and introduces the reduced pressure refrigerant into fluid line 33. The introduction of refrigerant from flash gas vessel 54 at a point between first and second compressor mechanisms 32, 34 can improve the performance of compressor mechanisms 32, 34.

It may be desirable to ensure that the refrigerant exiting flash gas vessel 54 and entering capillary tube 56 includes both liquid and vapor phase refrigerant. For example, it may be desirable that the refrigerant leaving the vessel 54 has the same liquid/vapor ratio as the refrigerant entering vessel 54. There are several possible methods of controlling the liquid/vapor ratio of the refrigerant exiting vessel 54. A first of these methods is to constantly stir the liquid/vapor mixture of refrigerant once the refrigerant has entered the vessel 54. A second method is to heat or cool the vessel 54. A third method is to provide the vessel 54 with physical characteristics that promote mixing of the liquid and vapor. Such physical characteristics may include the shape of the vessel 54 and the locations of the vessel's inlet and outlet.

Alternatively, the outlet of vessel 54 could be provided with a valve or gate to control the release of refrigerant from vessel 54. For example, such a gated outlet could be controlled based upon the density of the refrigerant in capillary tube 56. The density of the refrigerant within the capillary tube could be determined by the use of temperature and pressure sensors, or, the density could be determined by measuring the mass of the refrigerant and tube and subtracting the known mass of the tube.

It is also possible to add a filter or filter-drier to the system proximate any of the capillary tubes included in the above embodiments. Such a filter when placed upstream of the capillary tube can prevent contamination in the system, e.g., copper filings, abrasive materials or brazing debris, from collecting in the capillary tube and thereby obstructing the passage of refrigerant.

While this invention has been described as having an exemplary design, the present invention may be further modified within the spirit and scope of this disclosure. This application is therefore intended to cover any variations, uses, or adaptations of the invention using its general principles.

What is claimed is:

1. A transcritical vapor compression system comprising:

a fluid circuit circulating a refrigerant in a closed loop, said fluid circuit having operably disposed therein, in serial order, a compressor, a first heat exchanger, a first capillary tube and a second heat exchanger wherein said compressor compresses the refrigerant from a low pressure to a supercritical pressure, said first heat exchanger is positioned in a high pressure side of said fluid circuit and said second heat exchanger is positioned in a low pressure side of said fluid circuit, said first capillary tube reducing the pressure of the refrigerant from a supercritical pressure to a relatively lower pressure and wherein the refrigerant is passed through said first capillary tube at a velocity having a maximum value substantially equivalent to a critical flow velocity of the refrigerant;

means for controlling the temperature of the refrigerant in said first capillary tube, wherein said means for controlling the temperature of the refrigerant comprises a third heat exchanger disposed between said first heat exchanger and said first capillary tube; and an adjustable air mover operably coupled with said third heat exchanger.

2. The system of claim 1 wherein said third heat exchanger is configured to exchange thermal energy between the refrigerant at a first location in said high pressure side and the refrigerant at a second location in said low pressure side.

3. The system of claim 2 wherein said second location is disposed between said second heat exchanger and said compressor.

4. The system of claim 1 wherein the relatively lower pressure is a subcritical pressure.

5. The system of claim 1 wherein said means for controlling the temperature of the refrigerant comprises a heating device disposed in thermal exchange with said fluid circuit proximate said first capillary tube.

6. The system of claim 1, wherein said adjustable air mover is operable to produce a first airflow passing over said third heat exchanger and a second airflow passing over said third heat exchanger that is different from said first airflow.

7. The system of claim 6, wherein said adjustable air mover includes a first speed setting for producing said first airflow and a second speed setting for producing said second airflow.

8. The system of claim 6, wherein said adjustable air mover further includes a damper for adjusting the flow of air over said third heat exchanger between said first airflow and said second airflow.

9. A transcritical vapor compression system comprising:

a fluid circuit circulating a refrigerant in a closed loop, said fluid circuit having operably disposed therein, in serial order, a compressor, a first heat exchanger, a first capillary tube and a second heat exchanger wherein said compressor compresses the refrigerant from a low pressure to a supercritical pressure, said first heat exchanger is positioned in a high pressure side of said fluid circuit and said second heat exchanger is positioned in a low pressure side of said fluid circuit, said first capillary tube reducing the pressure of the refrigerant from a supercritical pressure to a relatively lower pressure and wherein the refrigerant is passed through the first capillary tube at a velocity having a maximum value substantially equivalent to a critical flow velocity of the refrigerant;

a device disposed in thermal exchange with said fluid circuit proximate said first capillary tube wherein the temperature of said refrigerant in said first capillary tube is adjustable with said device, wherein said device comprises a third heat exchanger disposed between said first heat exchanger and said first capillary tube, wherein said third heat exchanger is configured to exchange thermal energy between the refrigerant at a first location in said high pressure side and the refrigerant at a second location in said low pressure side, said second location disposed between said second heat exchanger and said compressor; and an adjustable air mover operably coupled with said third heat exchanger.

10. The system of claim 9 wherein said device includes a heating device.

11. The system of claim 9 wherein said device includes a cooling device.

12. The system of claim 9 further comprising a second capillary tube operably disposed in said fluid circuit between said first capillary tube and said second heat exchanger and a flash gas vessel operably disposed in said fluid circuit between said first and second capillary tubes, said compressor comprising a first compressor mechanism and a second compressor mechanism, and wherein a fluid line provides fluid communication from said flash gas vessel to a point between said first and second compressor mechanisms, said fluid line including a third capillary tube.

13. The system of claim 9, wherein said adjustable air mover is operable to produce a first airflow passing over said third heat exchanger and a second airflow passing over said third heat exchanger that is different from said first airflow.

14. The system of claim 13, wherein said adjustable air mover includes a first speed setting for producing said first airflow and a second speed setting for producing said second airflow.

15. The system of claim 13, wherein said adjustable air mover further includes a damper for adjusting the flow of air over said third heat exchanger between said first airflow and said second airflow.

16. A transcritical vapor compression system comprising:

a fluid circuit circulating a refrigerant in a closed loop, said fluid circuit having operably disposed therein, in serial order, a compressor, a first heat exchanger, a first capillary tube and a second heat exchanger wherein said compressor compresses the refrigerant from a low pressure to a supercritical pressure, said first heat exchanger is positioned in a high pressure side of said fluid circuit and said second heat exchanger is positioned in a low pressure side of said fluid circuit, said first capillary tube reducing the pressure of the refrigerant from a supercritical pressure to a relatively lower pressure and wherein the refrigerant is passed through said first capillary tube at a velocity having a maximum value substantially equivalent to a critical flow velocity of the refrigerant;

an internal heat exchanger exchanging thermal energy between the refrigerant at a first location in said fluid circuit between said first heat exchanger and said first capillary tube and the refrigerant at a second location in said low pressure side of said fluid circuit; and an adjustable air mover operably coupled with said internal heat exchanger.

17. The system of claim 16 further comprising a second capillary tube operably disposed in said fluid circuit between said first capillary tube and said second heat exchanger and a flash gas vessel operably disposed in said fluid circuit between said first and second capillary tubes, said compressor comprising a first compressor mechanism and a second compressor mechanism, and wherein a fluid line provides fluid communication from said flash gas vessel to a point between said first and second compressor mechanisms, said fluid line including a third capillary tube.

18. The system of claim 16, wherein said adjustable air mover is operable to produce a first airflow passing over said internal heat exchanger and a second airflow passing over said internal heat exchanger that is different from said first airflow.

19. The system of claim 18, wherein said adjustable air mover includes a first speed setting for producing said first airflow and a second speed setting for producing said second airflow.

20. The system of claim 18, wherein said adjustable air mover further includes a damper for adjusting the flow of air over said third heat exchanger between said first airflow and said second airflow.

21. A method of controlling a transcritical vapor compression system, said method comprising:

providing a fluid circuit circulating a refrigerant in a closed loop, the fluid circuit having operably disposed therein, in serial order, a compressor, a first heat exchanger, a first capillary tube and a second heat exchanger;

compressing the refrigerant from a low pressure to a supercritical pressure in the compressor;

removing thermal energy from the refrigerant in the first heat exchanger;

passing the refrigerant through the first capillary tube and reducing the pressure of the refrigerant in the first capillary tube;

adding thermal energy to the refrigerant in the second heat exchanger; and regulating the capacity of the system by controlling the mass flow rate of the refrigerant through the first capillary tube, wherein controlling the mass flow rate of the refrigerant through the first capillary tube comprises regulating the temperature of the refrigerant while passing the refrigerant through the first capillary tube at a substantially constant velocity, wherein regulating the temperature of the refrigerant in the first capillary tube comprises exchanging thermal energy between the refrigerant at a first location in the fluid circuit between the first heat exchanger and the first capillary tube and the refrigerant at a second location between the second heat exchanger and the compressor, wherein a third heat exchanger is provided to exchange thermal energy between the refrigerant at the first location and the refrigerant at the second location and controlling the temperature of the refrigerant in the first capillary tube further comprises controlling the movement of air across the third heat exchanger.

22. The method of claim 21 wherein the refrigerant is passed through the first capillary tube at a velocity approximately equal to the speed of sound.

23. The method of claim 21 wherein the refrigerant comprises carbon dioxide.

24. The method of claim 21 wherein the pressure of the refrigerant is reduced in the first capillary tube to a subcritical pressure.

25. A transcritical vapor compression system comprising:

a fluid circuit circulating a refrigerant in a closed loop, said fluid circuit having operably disposed therein, in serial order, a compressor, a first heat exchanger, a first capillary tube and a second heat exchanger wherein said compressor compresses the refrigerant from a low pressure to a supercritical pressure, said first heat exchanger is positioned in a high pressure side of said fluid circuit and said second heat exchanger is positioned in a low pressure side of said fluid circuit, said first capillary tube reducing the pressure of the refrigerant from a supercritical pressure to a relatively lower pressure and wherein the refrigerant is passed through the first capillary tube at a velocity having a maximum value substantially equivalent to a critical flow velocity of the refrigerant;

a device in thermal exchange with said fluid circuit disposed between said first heat exchanger and said first capillary tube, wherein said device includes a third heat exchanger; and a variable airflow device operably coupled with said third heat exchanger, said variable airflow device including a fan, said variable airflow device operable to produce at least a first airflow passing over said third heat exchanger and a second airflow passing over said third heat exchanger that is different from said first airflow.

26. The system of claim 25, wherein said fan includes a first speed setting for producing said first airflow and a second speed setting for producing said second airflow.

27. The system of claim 25, wherein said variable airflow device further includes a damper for adjusting the flow of air over said third heat exchanger between said first airflow and said second airflow.

* * * * *